United States Patent [19]

Hull et al.

[11] Patent Number: 4,678,024

[45] Date of Patent: Jul. 7, 1987

[54] HORIZONTAL ELECTROMAGNETIC CASTING OF THIN METAL SHEETS

[75] Inventors: John R. Hull, Hinsdale; Robert J. Lari, Aurora; Walter F. Praeg, Palos Park; Larry R. Turner, Naperville, all of Ill.

[73] Assignee: The United States of America as represented by the United States Department of Energy, Washington, D.C.

[21] Appl. No.: 872,725

[22] Filed: Jun. 10, 1986

[51] Int. Cl.[4] ..... B22D 27/02

[52] U.S. Cl. ..... 164/503; 164/440

[58] Field of Search ..... 164/467, 503, 440, 490

[56] References Cited

U.S. PATENT DOCUMENTS 4,146,078 3/1979 Rummel et al. ..... 164/467

*Primary Examiner*—Kuang Y. Lin

*Attorney, Agent, or Firm*—Hugh W. Glenn; Robert J. Fisher; Judson R. Hightower

[57] ABSTRACT

Thin metal sheets are cast by magnetically suspending molten metal deposited within a ferromagnetic yoke and between AC conducting coils and linearly displacing the magnetically levitated liquid metal while it is being cooled to form a solid metal sheet. Magnetic flux increases as the molten metal sheet moves downward and decreases as the molten metal sheet moves upward to stabilize the sheet and maintain it in equilibrium as it is linearly displaced and solidified by cooling gases. A conducting shield is electrically coupled to the molten metal sheet by means of either metal sheet engaging rollers or brushes on the solidified metal, and by means of an electrode in the vessel containing the molten metal thereby providing a return path for the eddy currents induced in the metal sheet by the AC coil generated magnetic flux. Variation in the geometry of the conducting shield allows the magnetic flux between the metal sheet and the conducting shield to be varied and the thickness in surface quality of the metal sheet to be controlled. Side guards provide lateral containment for the molten metal sheet and stabilize and shape the magnetic field while a leader sheet having electromagnetic characteristics similar to those of the metal sheet is used to start the casting process and precedes the molten metal sheet through the magnet and forms a continuous sheet therewith. The magnet may be either U-shaped with a single racetrack coil or may be rectangular with a pair of facing bedstead coils.

33 Claims, 16 Drawing Figures

HORIZONTAL ELECTROMAGNETIC CASTING OF THIN METAL SHEETS

CONTRACTUAL ORIGIN OF THE INVENTION

The United States Government has rights in this invention under Contract No. W-31-109-ENG-38 between the U.S. Department of Energy and Argonne National Laboratory.

BACKGROUND OF THE INVENTION

This invention relates generally to the casting of metal sheets and is particularly directed to the horizontal electromagnetic casting of thin metal sheets.

Steel making occupies a central economic role and represents a significant fraction of the energy consumption of many industrialized nations. The bulk of steel making operations involves the production of steel plate and sheet.

Present steel mill practice typically produces thin steel sheets by pouring liquid steel into a mold, whereupon the liquid steel solidifies upon contact with the cold mold surface. The solidified steel leaves the mold either as an ingot or as a continuous slab after it is coooled typically by water circulating within the mold wall during a solidification process. In either case, the solid steel is relatively thick, e.g., 6 inches or greater, and must be subsequently processed to reduce the thickness to the desired value and to improve metallurgical properties. The mold-formed steel is usually characterized by a surface roughened by defects, such as cold folds, liquations, hot tears and the like which result primarily from contact between the mold and the solidifying metallic shell. In addition, the steel ingot or sheet thus cast also frequently exhibits considerable alloy segregation in its surface zone due to the initial cooling of the molten surface from contact with the mold, reheating of the metal surface after mold contact, and then finally cooling of the metal surface from the direct application of a coolant. Subsequent fabrication steps, such as rolling, extruding, forging and the like, usually require the scalping of the ingot or sheet prior to working to remove both the surface defects as well as the alloy deficient zone adjacent to its surface. These additional steps, of course, increase the complexity and expense of steel production.

Steel sheet thickness reduction is accomplished by a rolling mill which is very captial intensive and consumes large amounts of energy. The rolling process therefore contributes substantially to the cost of the steel sheet. In a typical installation, a 10 inch thick steel slab must be manipulated by at least ten rolling machines to reduce its thickness. The rolling mill may extend as much as one-half mile and cost as much as $500 million.

Compared to currecnt practice, a large reduction in steel sheet total cost and in the energy required for its production could be achieved if the sheets could be cast in near net shape, i.e., in a shape and size closely approximating the final desired product. This would reduce the rolling mill operation and would result in a large savings in energy. There are several technologies currently under development which attempt to achieve these advantages by forming the thin steel sheets in the casting process. While some of the approaches under investigation use electromagnetic energy, all of these approaches use a solid mold on one or both sides of the sheet. One disadvantage of a mechanical mold is that contact between the molten metal and the solid mold wall often produces an undesirable surface finish which requires subsequent processing to correct as pointed out above.

The use of electromagnetic levitation techniques has been employed for some time in the aluminum industry. The practice there is to use electromagnetic fields to contain the top inch or so of a large, thick ingot. The molten aluminum is cooled and solidifies before it touches any mechanical support. Examples of this approach can be found in U.S. Pat. Nos. 3,467,166 to Getselev et al, 3,985,179 to Goodrich et al, 4,126,175 to Getselev, 4,161,206 to Yarwood et al, and 4,375,234 to Pryor.

Electromagnetic levitation of an electrically conducting molten body occurs when an alternating magnetic field generates induced eddy currents in the conducting material, primarily at its surface, and the induced currents interact with the external magnetic field to produce a magnetic pressure acting normal to the surface. If a sufficiently strong magnetic pressure is directed vertically upward, it can counteract the downward force of gravity on the body.

One of the difficulties with electromagnetic casting of metals involves the heating of the metal by eddy currents caused by the alternating magnetic field that levitates the molten metal. The heating by the magnetic field must be significantly less than the energy that can be removed by the cooling system or the molten metal will not solidify quickly. The heating increases as the static pressure head increases, and in the case of vertical levitation of a molten sheet, the pressure head may be several cm.

Horizontal electromagnetic casting offers several advantages over vertical casting. First, the entire casting system, including the post-solidification rollers can be on one floor of the factory, saving capital expense for the entire process. Second, the static pressure head that the magnetic fields must support need not be much more than the thickness of the plate to be cast. Thus, low field strength magnets can be used for the levitation.

A problem that is common to all electromagnetic levitation methods is the stability of the object to be levitated. The object must experience a restoring force whenever it departs from its intended equilibrium position. In the case of horizontal levitation, the upward net magnetic force must increase as the bottom surface of the molten sheet moves down, and the force must decrease as the bottom surface moves up. For the case of an isolated molten sheet suspended in a magnetic field, this requires that the horizontal component of the magnetic field decrease with height to obtain stability. To obey Maxwell's equations this requires that the vertical component of the magnetic field vary substantially across the sheet. The vertical component of the field contributes nothing to the levitation but contributes substantially to the eddy current heating. This heating in the horizontal case imposes a maximum on the width of the molten sheet.

In the horizontal levitation method, one way to avoid the large eddy heating of the vertical fields is to make the horizontal fields nearly constant. There is then no levitation in that the magnetic pressure on top of the molten sheet is the same as the magnetic pressure on the bottom, and no net magnetic force is generated on the molten sheet. The invention described herein overcomes this and other problems.

OBJECTS AND SUMMARY OF THE INVENTION

Accordingly, it is an object of the present invention to provide an improved method and arrangement for casting thin metal sheets.

It is another object of the present invention to produce thin metal sheets which require little or no subsequent rolling after the sheet is cast.

Yet another object of the present invention is to reduce the cost and complexity of casting thin metal sheets.

A further object of the present invention is to employ electromagnetic levitation in the casting of metal sheets in near final size and shape.

A still further object of the present invention is to produce thin metal sheets using less energy.

Still another object of the present invention is to produce a metal product having good metallurgical properties and surface characteristics as it leaves the caster.

Another object of the present invention is to cast molten metal in such a manner that the surface skin solidifies without mechanical contact with a mold or roller.

An additional object of the present invention is to electromagnetically cast metal sheet with a minimum of electromagnetic heating of the molten and solid metal.

Another object of the present invention is to provide a system and method which is particularly adapted for the continuous casting of thin sheets of steel.

This invention contemplates a magnet comprised of a ferromagnetic yoke and a pair of spaced AC conducting coils which develops a magnetic field adapted to receive and confine a molten metal in the form of a thin sheet. The molten metal sheet is linearly displaced through the magnet by the pressure of the molten metal as it exits the tundish and is initially cooled by a coolant gas stream to a solid sheet and may be further cooled by water or other liquid. Vertical stability is maintained by a compression of the magnetic flux below the metal when it moves down, thus increasing the lifting force and returning the sheet to its equilibrium position. The flux decreases as the metal sheet moves up, reducing the lifting force. Additional lifting force may be provided by gas pressure beneath the metal sheet where required.

The magnet may include either a closed rectangular ferromagnetic yoke or a U-shaped yoke and further includes a pair of side guards to shape the magnetic field so that it is horizontal and uniform in providing metal sheet stability and to also laterally confine the sheet. The closed rectangular magnet shape may include a pair of spaced bedstead AC conducting coils or racetrack-shaped coils, while the U-shaped yoke is provided with a single racetrack coil. A conducting shield is positioned adjacent to and above the molten metal sheet to, in combination with the side guards and liquid metal, exclude most of the magnetic flux from the region between the shield and the molten metal. The shield and molten metal are electrically connected in a closed loop. Magnetic damping of vertical oscillations of the liquid metal sheet may be provided by a DC magnetic field in the direction of flow of the metal. In addition, an AC coil may be positioned between the top of the liquid metal and the conducting shield or elsewhere to control the quality of the top surface of the liquid metal as desired.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

Figure 4:
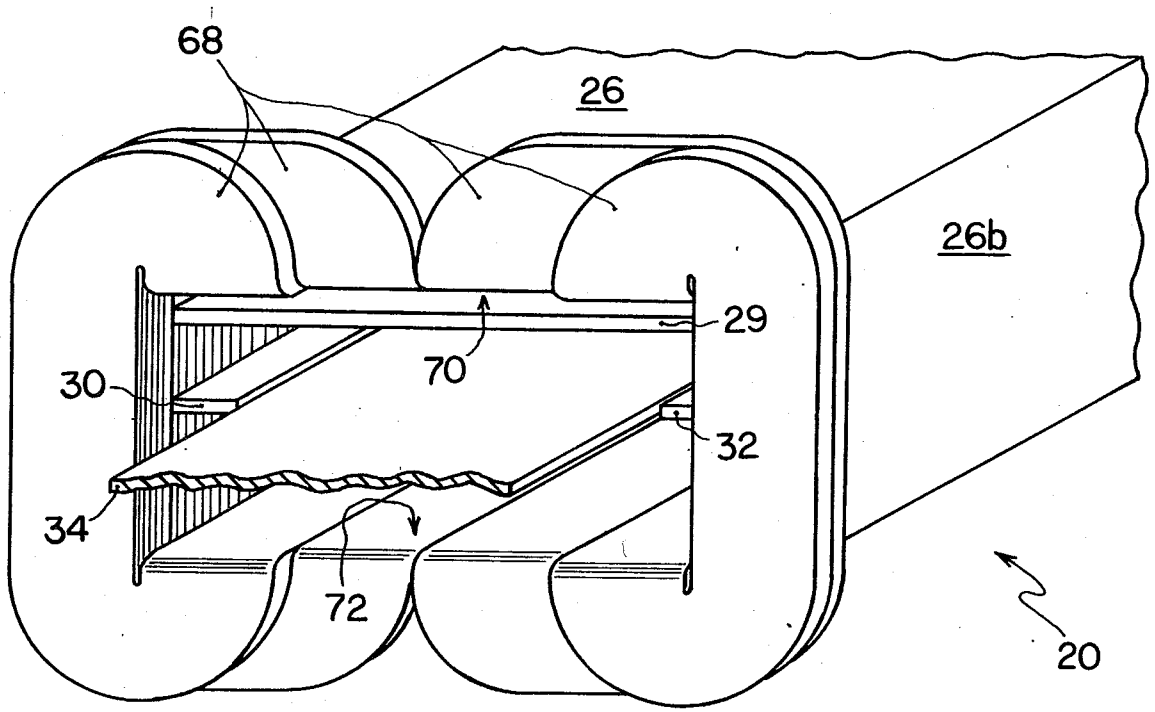
FIG. 4 is a perspective view of thin metal sheet casting apparatus incorporating a pair of facing bedstead AC conducting coils in accordance with another embodiment of the present invention.
Figure 7:
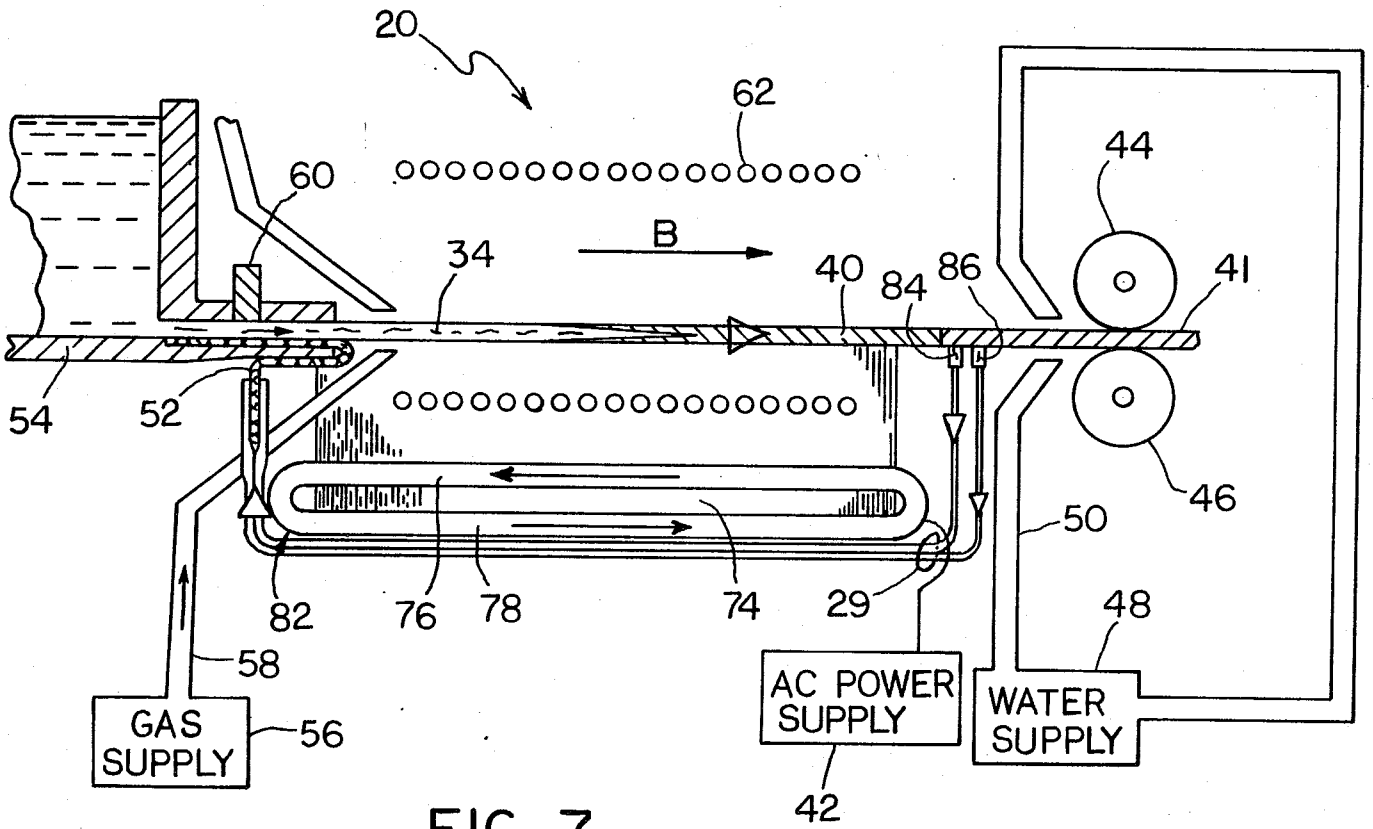
Figures 8, 9:
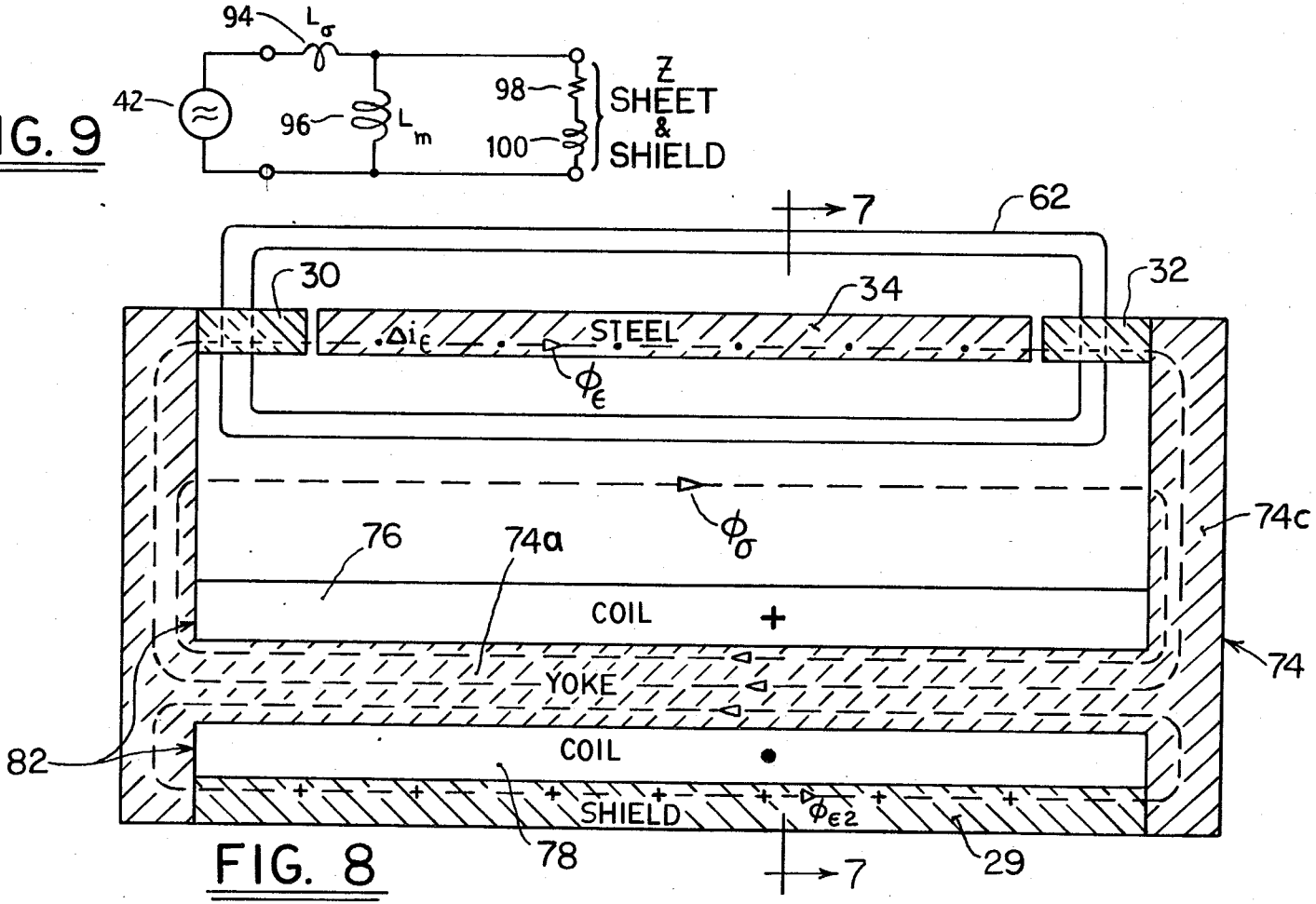
Figure 10:
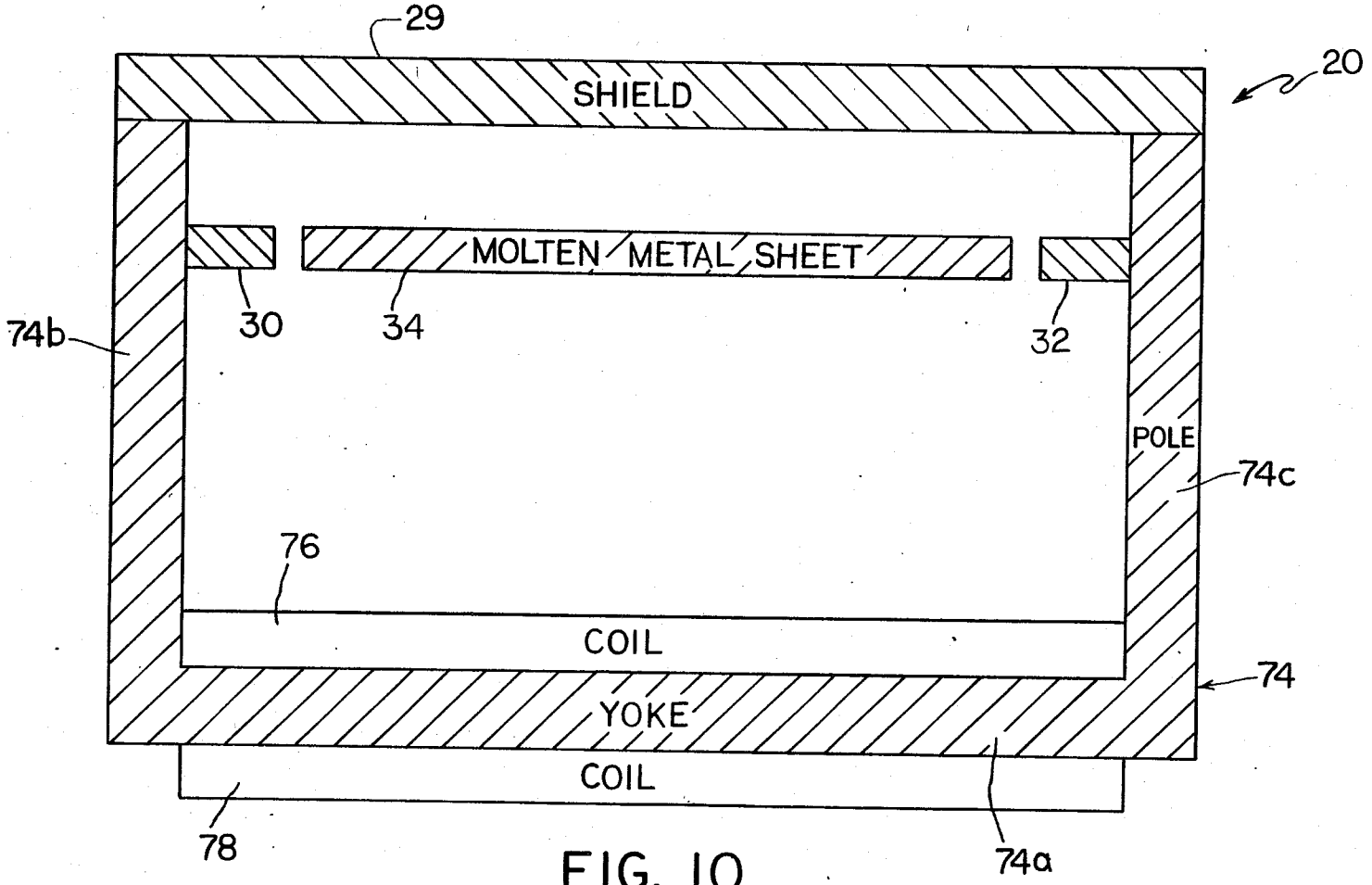
Figure 11:
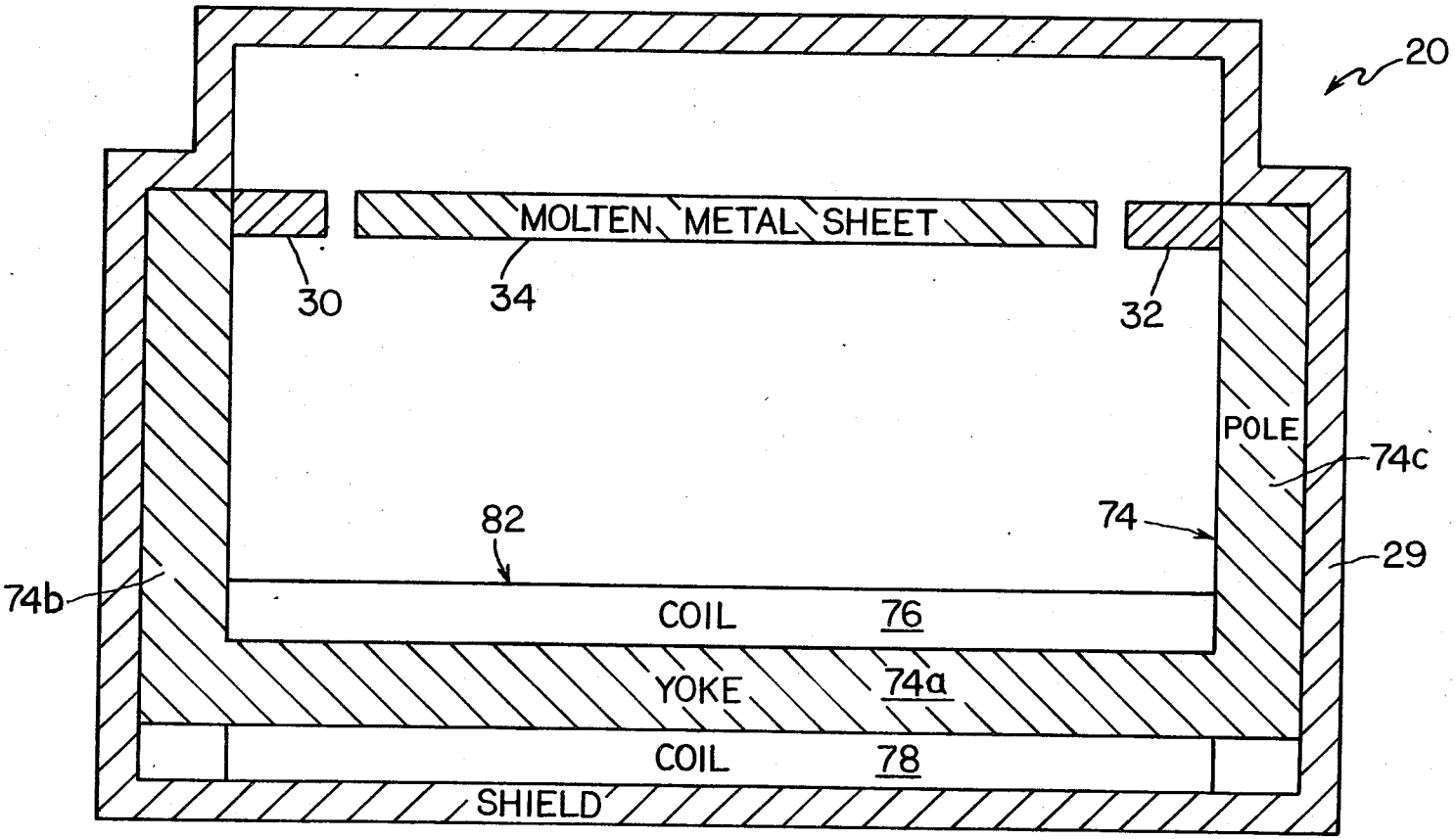
Figure 12:
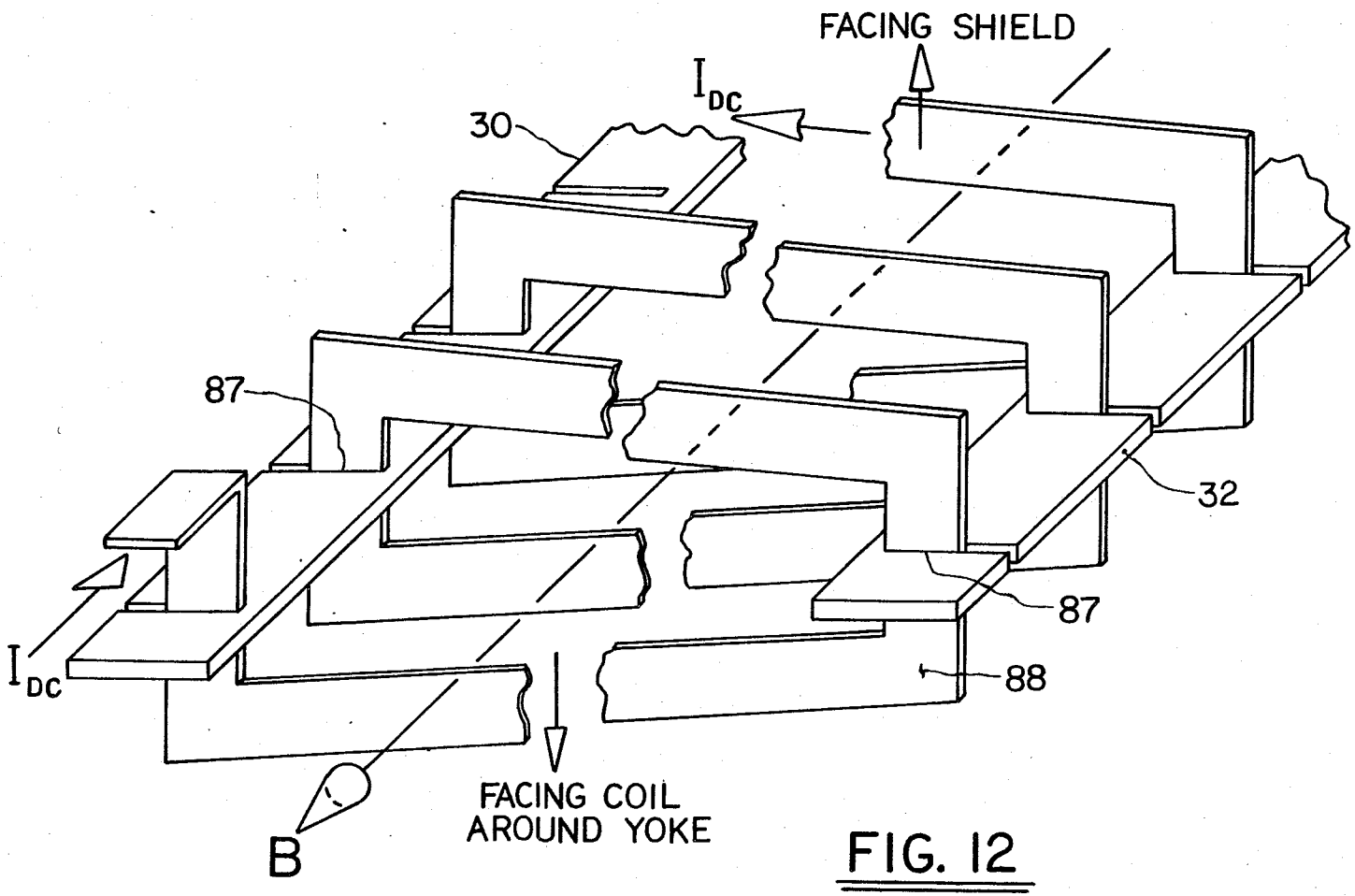
Figure 13:
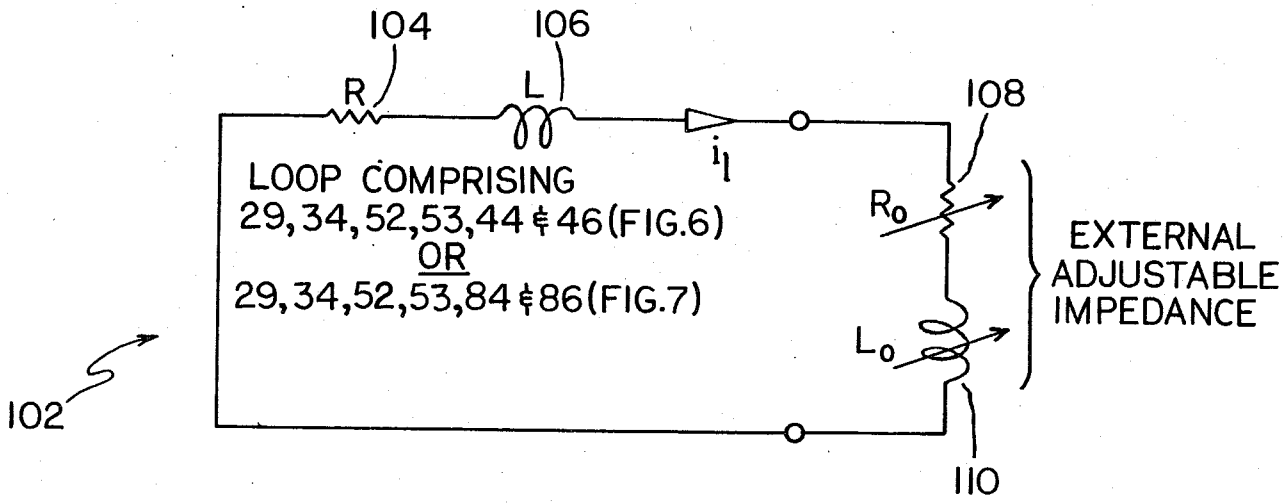
Figure 15:
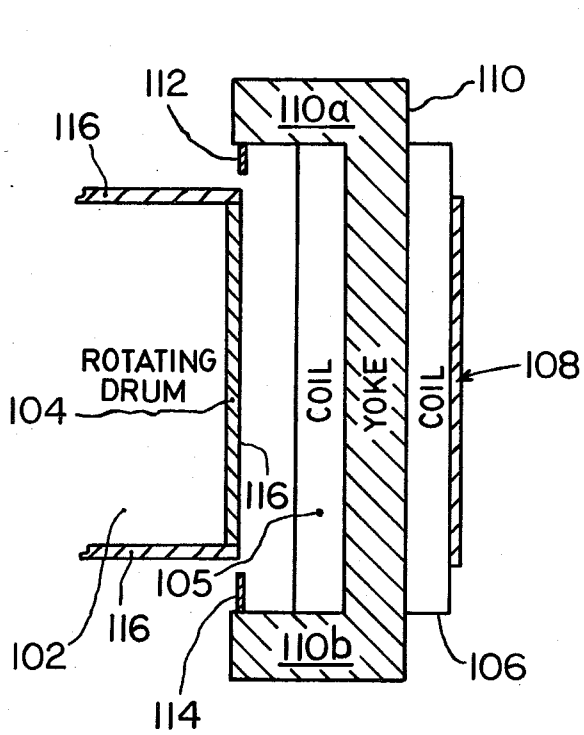
Figure 14:
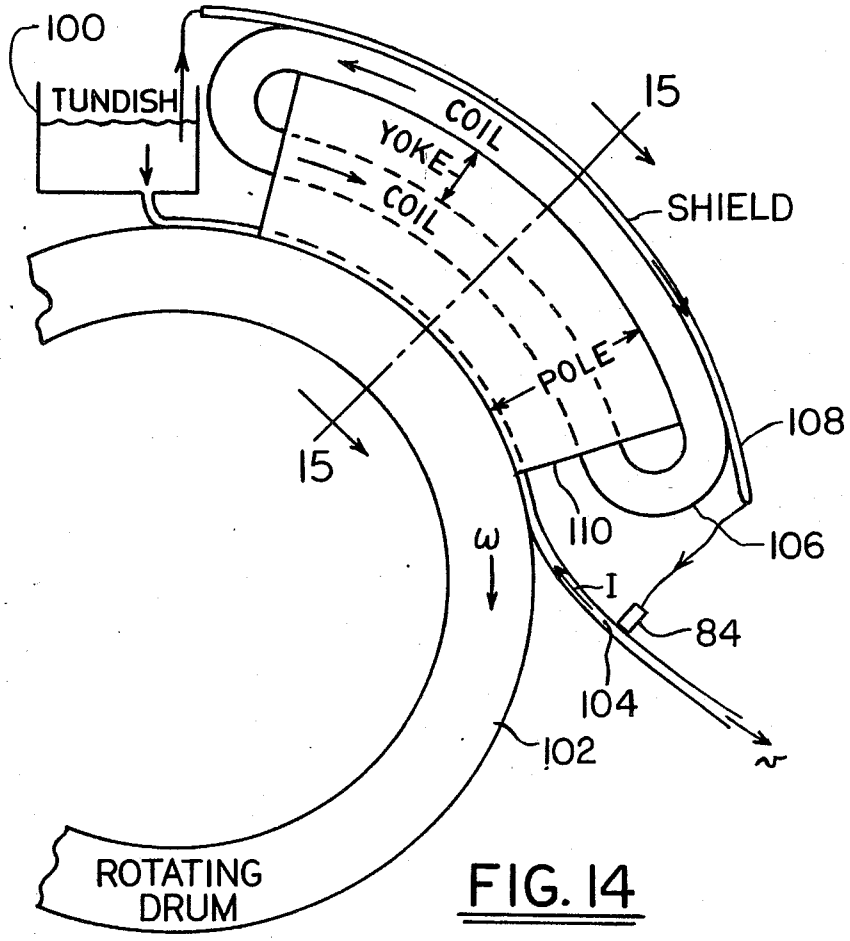

FIG. *6a* is a lateral sectional view of another embodiment of a horizontal electromagnetic metal sheet casting apparatus in accordance with the principles of the present invention;

FIG. 7 is a simplified lateral sectional view of a horizontal electromagnetic metal sheet casting apparatus in accordance with yet another embodiment of the present invention incorporating a U-shaped ferromagnetic yoke;

FIG. 8 is a cross sectional view illustrating the horizontal electromagnetic metal sheet casting apparatus of FIG. 7 having a conductive shield in a lower portion thereof, wherein are illustrated the currents and magnetic fields therein;

FIG. 9 is a schematic diagram of the circuit established in the electromagnetic metal sheet casting apparatus of FIG. 8 arising from the flow of eddy current therein;

FIG. 10 is a sectional view of the horizontal electromagnetic metal sheet casting apparatus of FIG. 7 wherein a conductive shield is positioned on an upper portion thereof;

FIG. 11 is a sectional view of the horizontal electromagnetic metal sheet casting apparatus of FIG. 7 completely enclosed in a conductive shield;

FIG. 12 is a perspective view of an insulated DC magnet winding incorporated in the side guards of the horizontal electromagnetic metal sheet casting apparatus of the present invention;

FIG. 13 is a schematic diagram of the equivalent circuit of the horizontal electromagnetic metal sheet casting apparatus of FIG. 4;

FIG. 14 is a lateral sectional view of yet another embodiment of a horizontal electromagnetic metal sheet casting apparatus in accordance with the principles of the present invention; and FIG. 15 is a sectional view taken along sight line 15—15 of the metal sheet casting apparatus of FIG. 14.

DETAILED DESCRIPTION OF THE PREFERRED EMBODIMENTS

Figure 1:
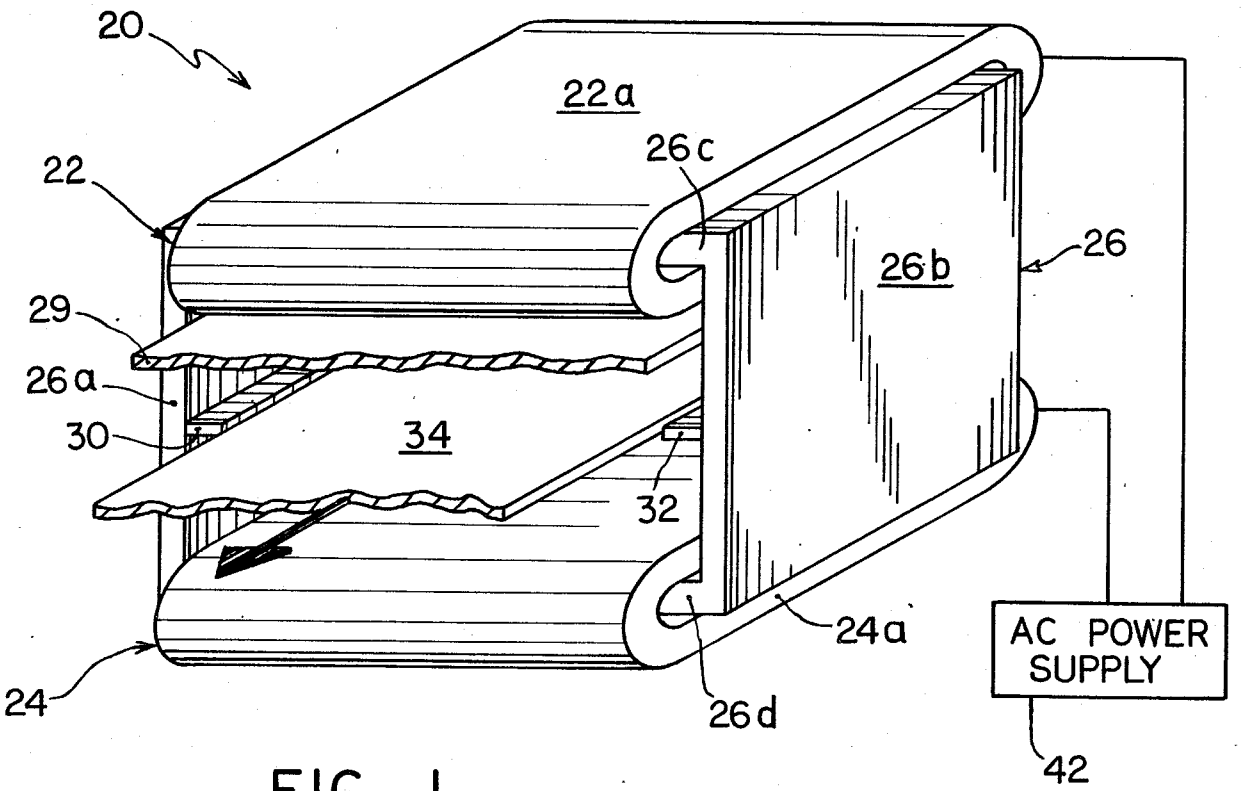
FIG. 1 is a perspective view of a thin metal sheet casting apparatus incorporating a pair of facing, spaced racetrack AC conducting coils in accordance with one embodiment of the present invention.
Figure 2:
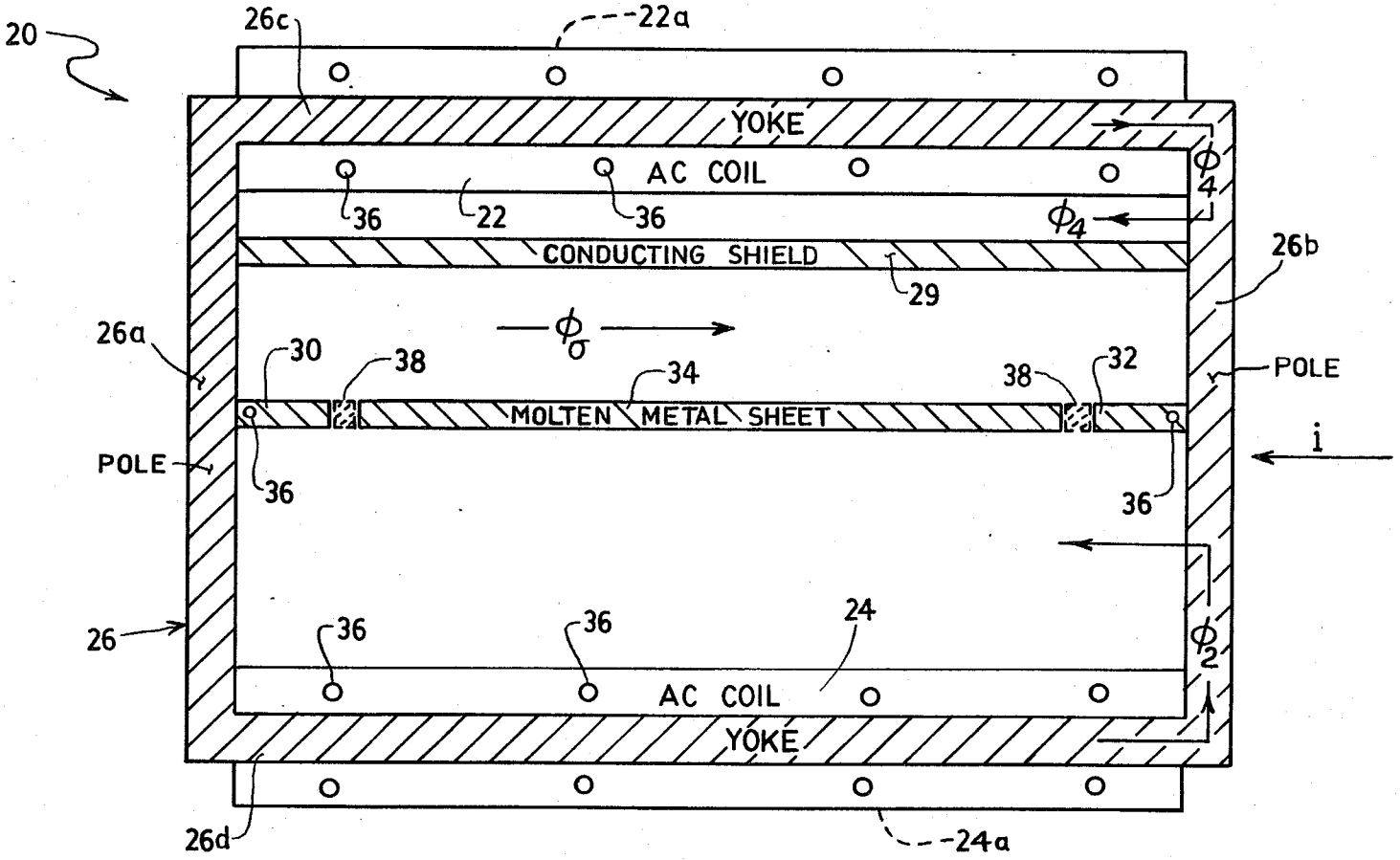
FIG. 2 is a cross sectional view of the thin metal sheet casting apparatus of FIG. 1.

Referring to FIG. 1, there is shown a perspective view of a thin metal sheet casting system 20 in accordance with the principles of the present invention. FIG. 2 illustrates a sectional view of the thin metal sheet casting system of FIG. 1.

The thin metal sheet casting system 20 includes a magnet comprised of first and second AC conducting coils 22, 24 and a generally rectangular, elongated ferromagnetic yoke 26 which includes first and second poles 26*a*, 26*b* and upper and lower members 26*c*, 26*d*. In the embodiment of the invention illustrated in FIGS. 1 and 2, the first and second AC conducting coils 22, 24 are of the general racetrack configuration wherein the outer sections of these coils are respectively identified by element numbers 22*a* and 24*a*.

A liquid or molten metal sheet 34 is deposited within the ferromagnetic yoke 26 and between the first and second AC conducting coils 22, 24 in a manner described below and is oriented generally horizontally therein. Disposed on respective lateral edge portions of the metal sheet and respectively mounted to the first and second pole portions 26*a*, 26*b* of the ferromagnetic yoke 26 are first and second side guards 30, 32. The side guards 30, 32 assist in shaping of the magnetic field generated by the first and second AC conducting coils 22, 24 and the ferromagnetic yoke 26 and also serve to laterally confine the molten metal sheet 34 within the ferromagnetic yoke 26. A conductive shield 29, preferably comprised of copper, is positioned within the ferromagnetic yoke 26 and is disposed between the molten metal sheet 34 and the first AC conducting coil 22. The upper and lower ferromagnetic yoke members 26*c*, 26*d* are aligned generally horizontally, while the first and second poles 26*a*, 26*b* of the ferromagnetic yoke are aligned generally vertically. The molten metal sheet 34 is directed in a manner described in detail below outward from the diagram of FIG. 2 and leftward as illustrated in FIG. 1.

The molten metal sheet 34 enters the ferromagnetic yoke 26 of the magnet at a controlled rate and speed through a feed system located at one end of the magnet which is not shown in FIG. 1 or 2 but is described in detail below. The upper and lower surfaces of the molten metal sheet are cooled by a cooling gas as described below and solidifies, with the thus solidified metal sheet exiting the magnet at the opposite end from the feed system. At this point, the solidified surface of the metal sheet is sufficiently thick that it can be supported by mechanical rollers and may be further cooled at this point by a water spray as described below.

The first and second AC conducting coils 22, 24 are connected to an AC power supply 42 which supplies alternating current at a frequency that provides a degree of penetration of the magnetic field into the molten metal sheet 34. Increasing alternating current frequencies provide smaller penetration of the magnetic field into the molten metal sheet 34. A typical frequency would be in the range of from approximately 1 kHz to 400 kHz, however, both higher and lower frequencies may be used. A uniform current density in the first and second AC conducting coils 22, 24 assists in producing a uniform magnetic field at the lower surface of the molten metal sheet 34 for improved support thereof. The AC conducting coils would typically be designed as high frequency coils with appropriate cooling 36.

Figure 3:
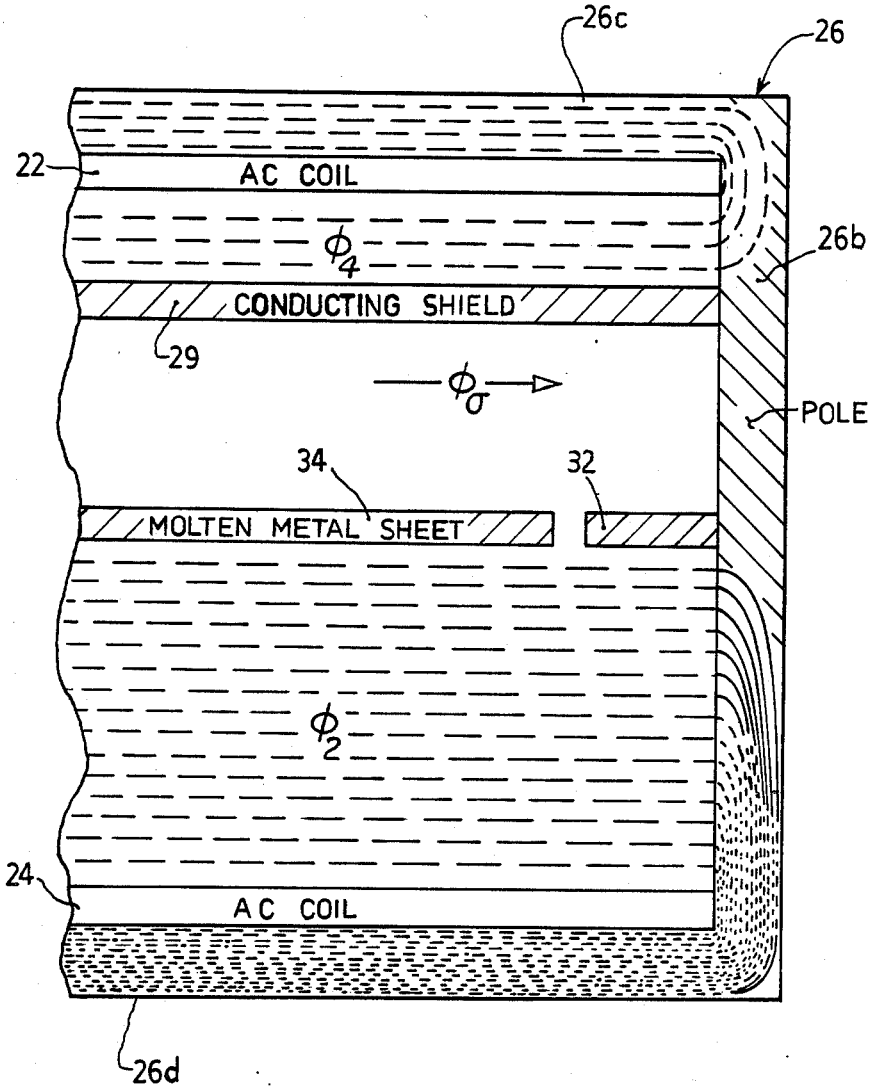
FIG. 3 is a portion of the sectional view of FIG. 2 illustrating the location and intensities of the magnetic fields within the electromagnetic thin metal sheet casting arrangement.

The first AC conducting coil 22 generates a magnetic flux $\phi_4$ within the ferromagnetic yoke 26 and in the space immediately above the copper shield 29. Similarly, the second AC conducting coil 24 generates a magnetic flux $\phi_2$ within the ferromagnetic core 26 and in the space below the molten metal sheet 34. The conducting shield 29, in combination with the first and second side guards 30, 32 and the molten metal sheet 34, excludes most of the magnetic flux from the region between the conducting shield and the molten metal sheet as shown in FIG. 3. The geometry of the conducting shield 29 can be chosen to allow some magnetic flux to penetrate the gap between the shield and the molten metal sheet, where it is necessary to help control the thickness or surface quality of the molten metal sheet. Thus, by reducing the width or length of the conducting shield 29, the magnetic flux $\phi_\sigma$ between the conducting shield and the molten metal sheet 34 may be increased to effect desired changes or characteristics in the molten metal sheet. The conducting shield 29 preferably is comprised of copper.

The first and second side guards 30, 32 straighten out the magnetic flux lines and orient them horizontally so as to provide a uniform magnetic flux below the molten metal sheet 34 and a high degree of support stability therefor. Without the side guards, the magnetic flux would be greater adjacent to the lateral edges of the molten metal sheet 34 causing a larger levitation force to be applied to the edges of the metal sheet, resulting in its "bowing." The effect of the first and second side guards 30, 32, the conducting shield 29 and the molten metal sheet 34 is to produce a magnetic flux which provides an increased levitation force when the molten metal sheet moves lower, and a reduced magnetic flux and decreased levitation force when the molten metal sheet moves upward. The side guards 30, 32 may also be provided with channels 36 or other means for cooling water circulation. If necessary, a ceramic material 38, shown in dotted line form in FIG. 2, may be placed in the gap between the first and second side guards 30, 32 and the respective lateral edges of the molten metal sheet 34 for reducing side guard heating and containing the molten metal sheet in the horizontal direction. Alternatively, conducting coils may be positioned on the side guards 30, 32 to restrict the horizontal movement of the molten metal sheet 34 and to contain it between the side guards. Conducting coils for this purpose are described in detail below. The uniformity of the magnetic field below the molten metal sheet 34 is improved if the electrical conductivity and thickness of the first and second side guards 30, 32 are approximately the same as those of the molten metal sheet 34.

Figure 5:
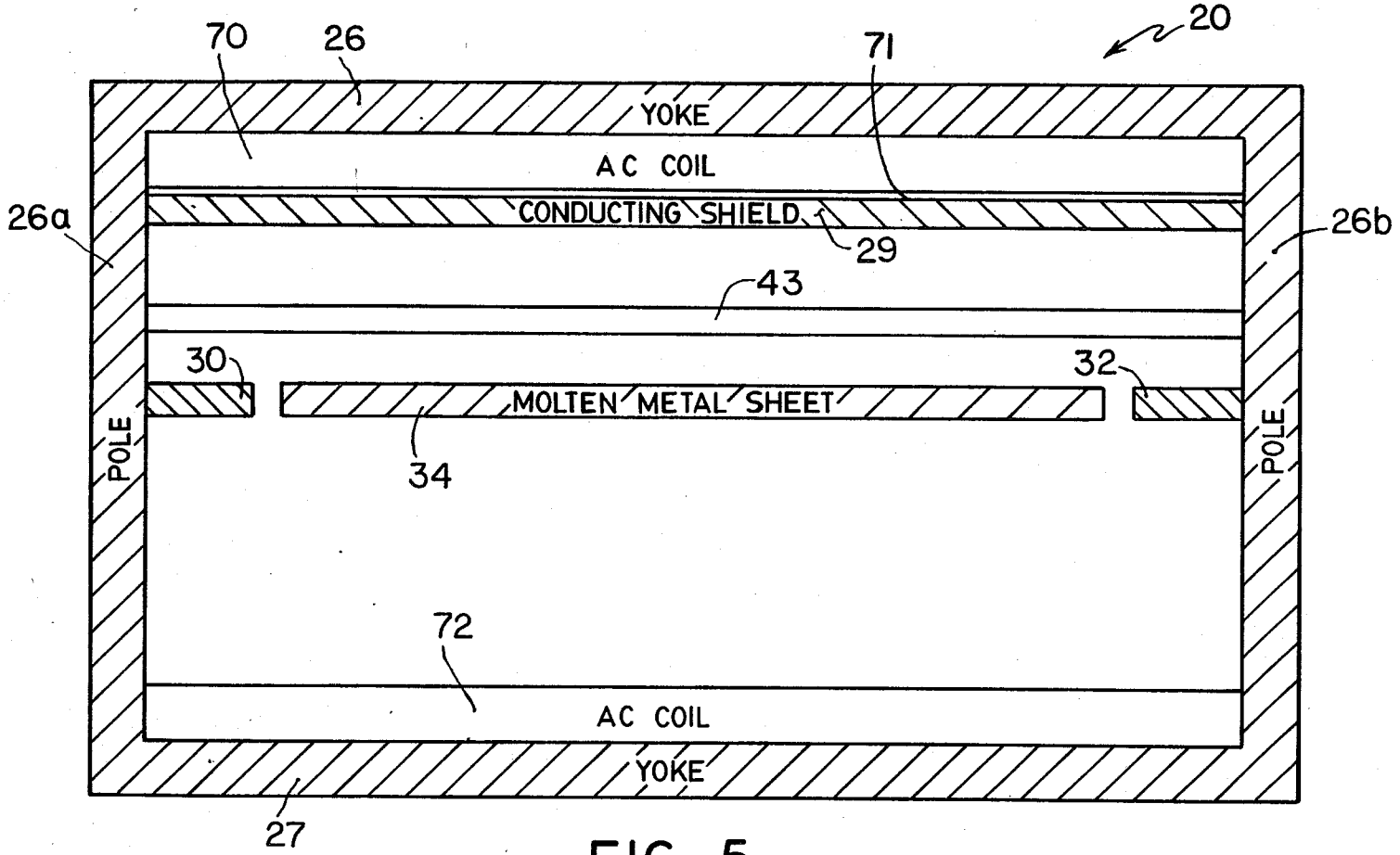
FIG. 5 is a sectional view of the apparatus of FIG. 4.

Referring to FIG. 4, there is shown a perspective view of another embodiment of the thin metal sheet casting system 20 of the present invention which makes use of a plurality of bedstead coils 68 which are aligned and configured so as to form a first, upper AC conducting coil 70 and a second, lower AC conducting coil 72. A sectional view of the bedstead coil arrangement of FIG. 4 is shown in FIG. 5 wherein the gap 71 between the conducting shield 29 and the first, upper AC coil 70 is minimized to reduce the inductance. Under some conditions it may be necessary to control the shape of the upper surface of the molten metal sheet 34 to prevent waves or other disturbances from forming therein. For this purpose, it may be necessary to impose a small magnetic field on the upper surface of the molten metal sheet 34. To accomplish this, a coil 43 may be positioned between the conductive shield 29 and the molten metal sheet or, in the alternative, the spacing between the conductive shield and the molten metal sheet may be adjusted to establish the required magnetic field on the upper surface of the molten metal sheet. In addition, the conducting shield 29 may be reduced in thickness or may be comprised of a wire mesh or a plurality of crossed metal strips to allow some of the magnetic flux from the first, upper AC coil 70 to leak through onto the upper surface of the molten metal sheet 34. Another approach could be to change the shape of those portions of the first and second poles 26*a*, 26*b* above the respective side guards. Another approach could be to change the electrical impedance of the conducting shield 29.

Figure 6:
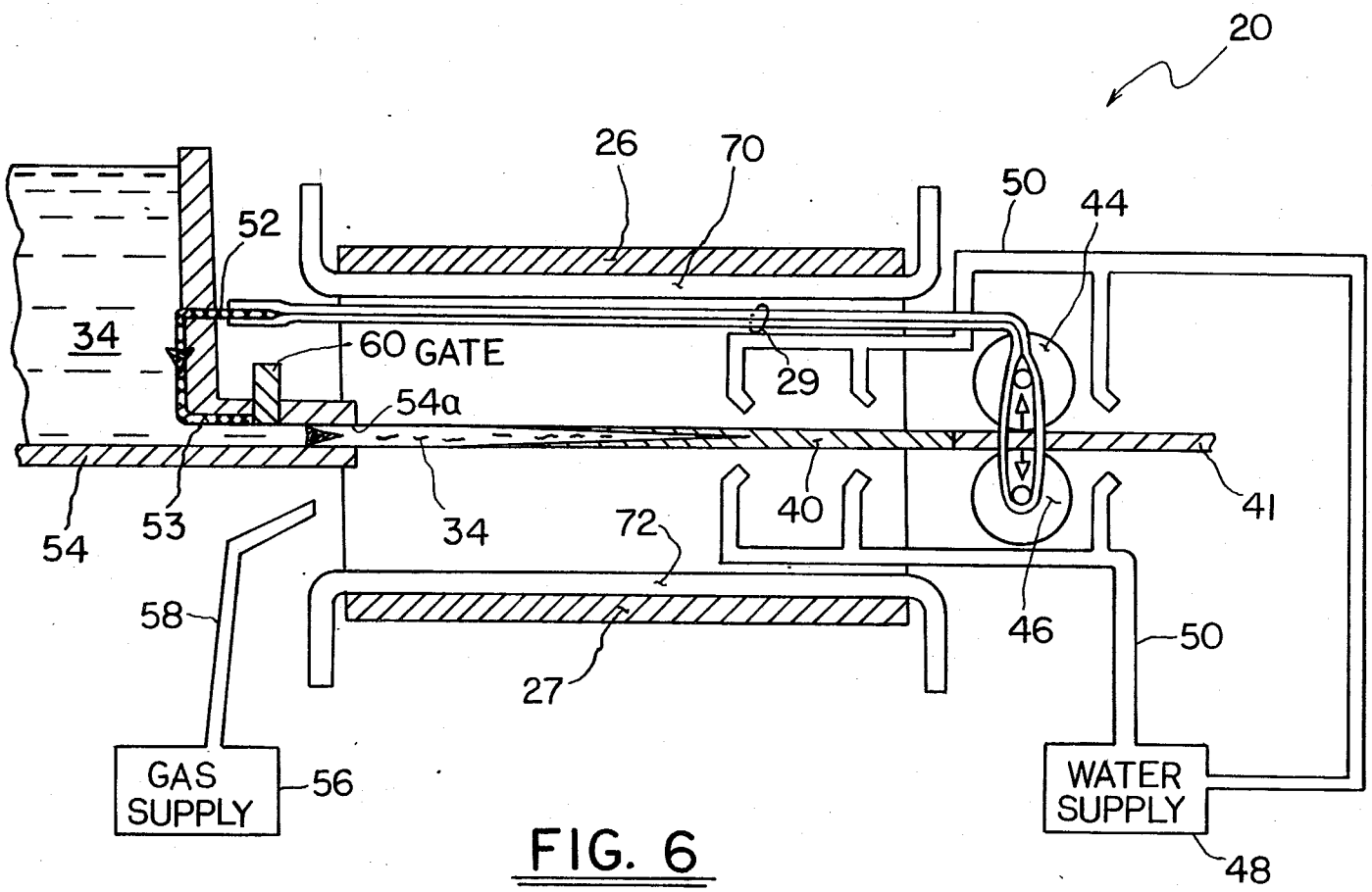
FIG. 6 is a lateral sectional view of the horizontal electromagnetic metal sheet casting apparatus of FIG. 4.

Referring to FIG. 6, there is shown in simplified schematic diagram form a horizontal sectional view of the thin metal sheet casting system 20 incorporating first upper and second lower AC bedstead coils 70, 72. In addition to the upper and lower AC coils 70, 72, the thin metal sheet casting system 20 includes a tundish 54 containing the molten metal 34 to be cast into thin sheets. The tundish 54 includes the combination of a gate 60 and an aperture 54*a* in a lower, lateral portion thereof by means of which the molten metal 34 may be discharged in a controlled manner from the tundish in the form of a thin sheet. The gate 60 may be conventional in design and may be operated by means of a conventional control system which is not shown in the figure. The conducting shield 29 positioned beneath the first, upper AC coil 70 is connected to the molten metal sheet 34 by means of a conductor 52 which has a higher melting point than the metal being cast into thin sheets. The conductor 52 is selected so as to have no significant chemical interaction with the molten metal 34 and may include a tungsten or other portion 53 where the molten metal itself is steel. As shown in the figure, the molten metal 34 forms a V-shaped interface with the solidified metal 40 which has been cooled by means of an inert, low temperature gas or mist directed onto the molten metal sheet by means of the combination of a cooling gas supply 56 and gas delivery tubes 58 on the top and bottom of molten metal 34.

A leader plate 41 having the same cross section as the molten metal sheet 34 to be cast extends into the tundish 54 before the tundish gate 60 is opened. The leader plate 41 defines the initial electromagnetic conditions prior to casting of the molten metal sheet 34 and its electrical characteristics should match as closely as practicable the characteristics of the molten metal sheet in order to minimize start-up transients. Where the molten metal sheet is comprised of steel, the leader plate 41 may be made from non-magnetic stainless steel or from steel heated to or above its Curie point (the temperature at which the steel being cast becomes substantially non-magnetic). The solidified steel sheet 40 remains at a temperature in excess of its Curie point while inside the thin metal sheet casting system 20 and is electrically connected to the conducting shield 29 via support rollers 44, 46. Thus, conductive shield 29, conductor 52, steel portion 53, the molten and solidified metal sheets 34, 40, and the first and second rollers 44, 46 forms a shorted turn that provides a return path for the eddy currents induced in the molten metal sheet by flux generated by the upper and lower AC coils 70, 72. The arrow tips shown in FIG. 6 illustrate the closed loop current path within the thin metal sheet casting system 20.

In a preferred embodiment, the cooling gas delivered by the gas supply 56 and gas delivery tube 58 is an inert gas such as argon which is directed onto the molten metal sheet 34 and prevents steel oxidation. The bedstead coils 68 of FIGS. 4–6 are more economical than the racetrack coils 22, 24 of FIGS. 1–3 when the aspect ratio of length of width of the thin metal sheet casting system is relatively large. The first and second rollers 44, 46 not only serve to complete the aforementioned electrical circuit, but also serve to draw the leader plate 41 as well as the solidified metal sheet 40 through and from the thin metal sheet casting system 20. The thus formed solidified metal sheet 40 may be further cooled by means of cold water jets directed thereon by means of the combination of a coolant water supply 48 and water delivery ducts 50.

Figure 6A:
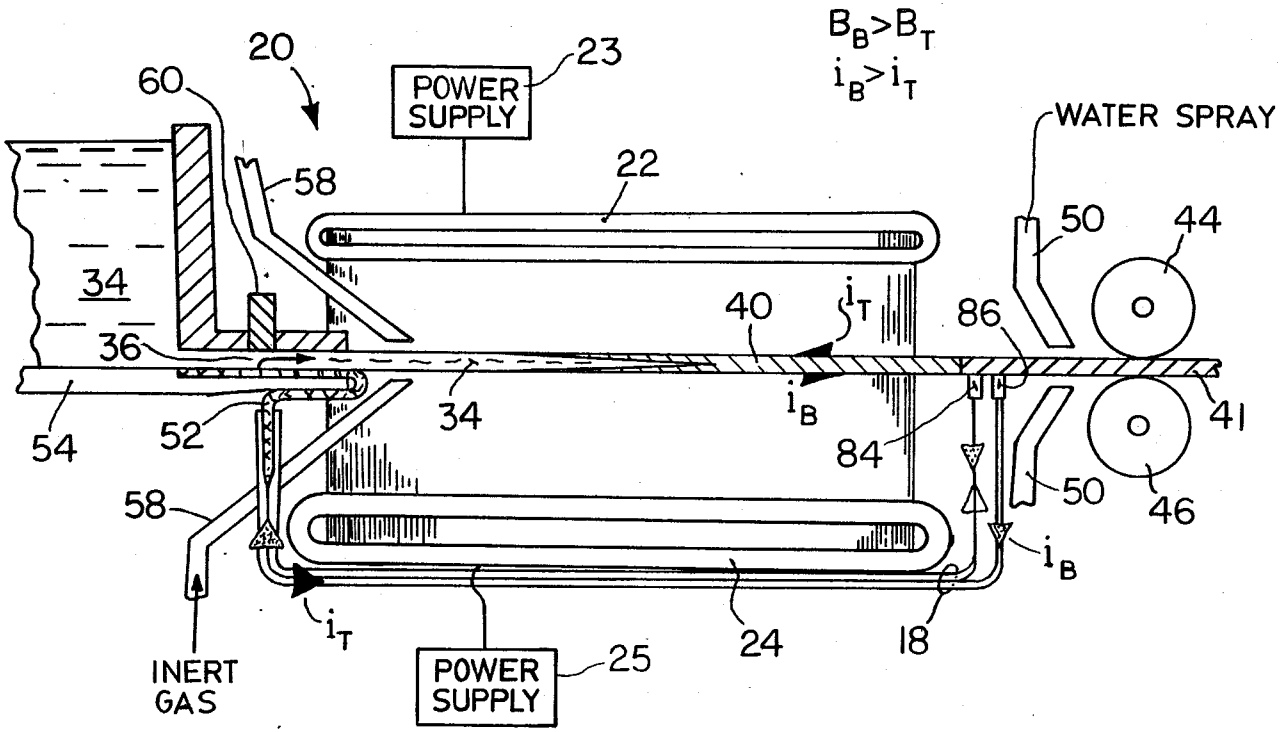

Referring to FIG. 6*a*, there is shown a lateral sectional view of yet another embodiment of a thin metal sheet casting system 20 in accordance with the present invention wherein the upper racetrack coil 22 is coupled to a first power supply 23 and the second racetrack coil 24 is coupled to a second power supply 25. By thus isolating and energizing the first and second racetrack coils 22, 24 by means of separate AC power supplies 23, 25, the current and frequency of the first upper racetrack coil can be made to differ from the current and frequency in the second lower racetrack coil. In this manner, the lower second racetrack coil 24 may provide levitation for the molten metal sheet 34, while the upper first racetrack coil 22 may provide the upper surface of the molten metal sheet with a desired quality or surface characteristics. The current in the lower second racetrack coil 24 may be made greater than the current in the first upper racetrack coil 22, where $i_B > i_T$. This permits the lower magnetic field $B_B$ to be greater than the upper magnetic field $B_T$ where the lower magnetic field provides a levitation force.

Referring to FIG. 7, there is shown yet another embodiment of a thin metal sheet casting system 20 in accordance with the present invention. In the embodiment of FIG. 7, a single racetrack AC conducting coil 82 comprised of upper and lower conducting portions 76, 78 is positioned in a lower portion of the thin metal sheet casting system 20. A sectional view of the embodiment of the thin metal sheet casting system 20 of FIG. 7 is shown in FIG. 8. In this latter embodiment, the conducting shield 29 is positioned beneath the racetrack AC conducting coil 82 and immediately adjacent to the lower portion of a U-shaped ferromagnetic core 74. The magnetic flux $\phi$ is essentially confined to the paths shown in FIG. 8 by providing a return path for the eddy currents within the molten metal sheet 34 through the conducting shield 29 positioned beneath the lower conducting portion 78 of the AC conducting racetrack coil 82. In order to reduce losses, the conducting shield 29 may be in the form of a plurality of thin, insulated copper sheets. The eddy currents $\Delta i_e$, i.e., current flowing close to that surface of the thin metal sheet 34 which faces the AC conducting coil 82, flow in a closed loop comprised of first and second brushes 84, 86, conducting shield 29, conductor 52, the liquid metal both within the tundish 54 and that which flows from the aperture therein so as to form the molten metal sheet 34, and back to the solidified metal sheet 40. The direction of eddy current flow is shown by the arrows in FIG. 7, while the direction of current flow within the AC conducting coil 82 is shown by the +sign and "dot" symbols in FIG. 8. The ampere-turns of the shorted turn comprising the molten metal sheet 34 and the conducting shield 29 have, by transformer action, essentially the same value as the ampere-turns of the AC conducting coil 82. The AC conducting coil 82 carries an additional relatively small magnetizing current.

The equivalent circuit of the shorted turn comprised of the molten metal sheet 34 and the conducting shield 29 is shown in schematic diagram form in FIG. 9. Regulation of the voltage (rather than the current) of the magnet AC power supply 42 augments the effect of the first and second side guards 30, 32 in providing vertical positioning stability for the molten metal sheet 34. The molten metal sheet 34, the magnet comprised of the U-shaped ferromagnetic core 74 and AC conducting racetrack coil 82, and the AC power supply 42 form an inductively coupled circuit. As shown in FIG. 9, $L_\sigma$ 94 represents the inductance of the air gap between the two poles **74*b*, 74*c* of the ferromagnetic yoke 74, while $L_m$ 96 represents the inductance of the magnet. Similarly, the impedance of the molten metal sheet 34 and the conducting shield 29 is represented in FIG. 9 as the series arrangement of resistance 98 and inductance 100. If the molten metal sheet 34 moves downward, its inductance decreases and the coil current, the magnetic field, and the levitating force undergoes a corresponding increase. If the molten metal sheet 34 moves upward, the inductance undergoes a corresponding increase resulting in a decrease in the coil current, the magnetic field, and the levitating force exerted on the molten metal sheet. It is in this manner that the molten metal sheet 34** is maintained in an equilibrium position within the magnet.

An additional enhancement to the previously discussed embodiments of the thin metal sheet casting system 20 of the present invention involves the provision of a magnetic damping system to damp vertical oscillations of the molten metal sheet 34. Such a damping provision would be necessary where the feed system comprised of the tundish 54 and gate 60 does not deliver the molten metal sheet 34 at precisely the correct conditions. The magnetic damping system could be comprised of a conventional solenoid magnet 62 as shown in FIG. 7 for generating a DC magnetic field B in the direction of the flow of the molten metal sheet 34, or from left to right as shown in FIG. 7. This DC magnetic field would not interfere with the flow of the molten metal sheet 34 in the direction of the magnetic field, but would serve to rapidly dampen departures of the molten metal sheet from its equilibrium position perpendicular to the direction of the DC magnetic field. As shown in FIG. 7, the molten metal sheet 34 is enclosed within the DC magnetic field-generating solenoid magnet 62.

Additional embodiments of the thin metal sheet casting system 20 of the present invention are shown in FIGS. 10 and 11. In FIG. 10, the generally vertically oriented first and second poles **74*b*, 74*c* of the U-shaped ferromagnetic yoke 74 extend above the first and second side guards 30, 32 and the molten metal sheet 34 and are bridged by the conducting shield 29. The conducting shield 29 forms part of a shorted turn that provides a return path for the eddy currents induced in the molten metal sheet 34. The shorted turn, by transformer action, maintains the space between the molten metal sheet 34 and the conductive shield 29 essentially free of magnetic flux and thus eliminates the application of a vertically directed downward force on the upper surface of the conductive metal sheet. The conductive shield 29 further serves to define the upper cooling gas channel within which a cooling gas may be directed upon the upper surface of the molten metal sheet 34**.

By completely enclosing the AC conducting racetrack coil 82, the ferromagnetic yoke 74, the first and second side guards 30, 32, and the molten metal sheet 34, within the conductive shield 29 as shown in FIG. 11, the magnetic flux outside of the conductive shield is minimized. The eddy currents induced in the levitated molten metal sheet 34 in the arrangement of FIG. 11 returns through the conductive shield 29.

Referring to FIG. 12, there is shown an insulated DC magnetic winding 88 for insertion through slots 87 in the first and second side guards 30, 32, where the top of winding 88 passes between shield 29 and molten metal 34, and the bottom of winding 88 passes between molten metal 34 and coil 76 for forming the aforementioned DC magnetic field around the molten magnetic sheet which is aligned with the direction of displacement of the molten metal sheet for providing damping of vertical oscillations of the molten metal sheet. The DC magnetic windings 88 within the first and second side guards 30, 32 are respectively positioned adjacent to the first and second poles **74*b*, 74*c* of the ferromagnetic core 74 and to the first and second AC conducting coils in order to have the DC solenoid magnetic field return through the aforementioned first and second poles and the upper and lower members 26*c*, 26*d* of the ferromagnetic yoke 26 as shown in FIG. 2. The DC magnetic winding 88 includes a plurality of turns made from thin conductors with a large aspect ratio for its cross section as illustrated in FIG. 12. The smaller edges of the DC magnet winding 88 face the first and second poles 74*b*, 74*c* of the ferromagnetic yoke 74 and the first and second AC conducting coils 22, 24. The large edge portions of the DC magnet winding 88 are equal to or less than the width of the first and second side guards 30, 32 to permit the DC magnet winding to be positioned within each of the side guards while remaining insulated therefrom. The distance between turns of the DC magnet winding 88 is made as large as is compatible with a DC field ripple on the surface of the molten metal sheet 34**.

The shorted turn in the thin metal sheet casting system of FIG. 6 comprised of the molten metal sheet 34, first and second rollers 44, 46, conductive shield 29, the conductor 52, and the steel portion 53 within the tundish 54 encircles the leakage flux $\phi_\sigma$ as illustrated in FIGS. 2 and 3. This relatively small AC magnetic flux aids in driving the levitating current i through the shorted loop of FIG. 12 given by the following expression:

$$\frac{d\phi_\sigma}{dt} = i_1 (R + j2\pi fL) \tag{1}$$

where f is frequency.

By inserting into the current loop of FIG. 13 an adjustable impedance given by the expression ($R_o$+j2$\pi$fL), the magnetic flux between the molten metal sheet 34 and the conductive shield 29 can be controlled as shown in FIG. 13. For example, with a very large impedance, i.e., approaching that of an open circuit, the magnetic flux density in the space between the molten metal sheet 34 and the conductive shield 29 wll be approximately equal to the flux density in the space between the conductive shield and the first, upper AC conducting coil or between the molten metal sheet and the second, lower AC conducting coil 24. The external impedance given by the values of $R_o$ and $L_o$ is selected such that the magnetic flux above the molten metal sheet 34 is in phase with the levitating flux.

In the AC magnetic field approach described above, a significant amount of heat is generated in the molten metal sheet by the eddy currents generated therein. This heat places demands upon the heat removal requirements of the coolant gas directed upon the molten metal sheet. In order to reduce the heat generated in the molten metal sheet and to relax the requirements imposed upon the electrode material, an alternative approach is the use of a differential in the gas pressure to provide levitation for the molten metal sheet while employing electromagnetic force to provide molten sheet stability. Thus, as shown in FIG. 7, the coolant gas supply 56 would exert a greater pressure on the lower surface of the molten metal sheet 34 than on the upper surface thereof in order to provide a levitating force for the metal sheet. The gas pressure under the molten metal sheet $P_L$ is thus greater than the gas pressure above the molten metal sheet $P_U$, with their relationship given by the expression:

$$P_L = \rho g h + P_u, \quad (2)$$

where $\rho$ is the density of the liquid metal, g is the acceleration of gravity, and h is the thickness of the metal sheet.

Because the molten metal sheet is heavier than the gas below it, it will exhibit a Rayleigh-Taylor instability. To avoid this instability $P_L$ is established sightly lower than that given by Equation 2 above the remaining levitational pressure is provided by the magnetic field $P_m$ such that:

$$P_L + P_m = P_u + \rho g h. \quad (3)$$

The magnetic field must exhibit a sufficiently strong restoring force such that it prevents both a Rayleigh-Taylor and a Kelvin-Helmholtz instability which arises from the velocity of the gas flow. Preliminary calculations indicate that $P_m$ can be made 10% of $P_L - P_U$ or less, greatly reducing the electromagnetic heating in the AC case and the required current in the DC case.

Referring to FIGS. 14 and 15 there are shown sectional views of yet another embodiment of the present invention. In the thin metal sheet casting system of FIGS. 14 and 15, molten metal is deposited from a tundish 100 onto an upper portion of a rotating drum 102 and is angularly displaced through a magnet comprised of a C-shaped ferromagnetic yoke 110 and first and second AC conducting coils 105 and 106. A conductive shield 108 is positioned immediately adjacent to and radially outward from the second AC conducting coil 106 and is electrically connected to the liquid steel in the tundish and to the solid steel with brushes 84 or rollers as described above. The magnetic flux between the poles 110*a*, 110*b* of the ferromagnetic yoke 110 exert a pressure on the molten metal sheet 104 which is directed toward the center of the rotating drum 102 so as to maintain the molten metal sheet in position upon the drum as it rotates. This magnetic pressure is equal to or exceeds the centrifugal pressure of the rotating molten metal sheet which may be stripped or removed from the rotating drum 102 as the molten metal sheet exits the magnet. The edge of the rotating drum 102 includes a stainless steel disk or washer 116 which extends over the drum as a lip to contain the molten steel at the sides.

There has thus been shown an arrangement for the horizontal electromagnetic casting of thin metal sheets particularly adapted for the production of high quality, uniform thin steel sheets at low cost. The metal sheet casting arrangement of the present invention may be operated on small amounts of electrical energy and the thin metal sheets thus produced require a minimal amount of subsequent mill rolling. With mill rolling thus minimized, the entire thin metal sheet casting arrangement and finishing process may be located on the same floor in the steel manufacturing plant and requires a substantial reduced capital cost as compared with that of a conventional rolling mill and casting operation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. Apparatus for the horizontal casting of thin metal sheets comprising:

vessel means containing a molten metal and including an aperture for discharging said molten metal in the form of a thin, horizontal sheet;

electromagnetic conducting means positioned adjacent to the aperture in said vessel means and in spaced relation from said molten metal sheet for directing a horizontal magnetic field across and about said molten metal sheet; and conductive shield means positioned within said magnetic field and electrically coupled to said molten metal sheet for defining a horizontally oriented equilibrium position of the molten metal sheet within said magnetic field wherein the strength of said magnetic field increases with increasing displacement of said molten metal sheet below said equilibrium position and decreases with increasing displacement of said molten metal sheet above said equilibrium position such that said magnetic field exerts a constant, uniform levitation force on said molten metal sheet.

2. The apparatus of claim 1 further comprising first and second side guard means positioned adjacent to a respective lateral edge of the molten metal sheet for shaping the horizontal magnetic field and for laterally confining said molten metal sheet.

3. The apparatus of claim 2 wherein each of said first and second side guard means includes an insulating inner edge.

4. The apparatus of claim 3 wherein said insulating inner edge is comprised of a ceramic material.

5. The apparatus of claim 2 wherein each of said first and second side guards supports a DC conducting coil for applying a DC magnetic field to the molten metal sheet for stabilizing the molten metal sheet by dampening out vertical oscillations thereof.

6. The apparatus of claim 5 wherein said DC conducting coil is generally helically wound and includes a longitudinal axis aligned with the direction of displacement of said molten metal sheet.

7. The apparatus of claim 2 wherein each of said side guard means includes a respective duct within which a liquid coolant is circulated.

8. The apparatus of claim 1 wherein said electromagnetic conducting means includes first and second vertically spaced AC conductors respectively positioned above and below the molten metal sheet.

9. The apparatus of claim 8 wherein each of said first and second AC conductors are racetrack conducting coils and are aligned along the direction of displacement of the molten metal sheet.

10. The apparatus of claim 9 wherein the electromagnetic conducting means further includes a ferromagnetic yoke having first and second poles positioned adjacent to respective edges of the molten metal sheet.

11. The apparatus of claim 10 wherein said ferromagnetic yoke further includes first and second cross members coupling respective ends of said first and second poles and disposed within a respective racetrack conducting coil.

12. The apparatus of claim 8 wherein said first and second AC conductors are each comprised of bedstead conducting coils.

13. The apparatus of claim 12 wherein said electromagnetic conducting means further includes a ferromagnetic yoke having first and second poles positioned adjacent to a respective lateral edge of the molten metal sheet and first and second cross members respectively positioned above and below the upper and lower bedstead coils and coupling said first and second ferromagnetic yoke poles.

14. The apparatus of claim 8 wherein each of said first and second AC conductors includes cooling means for cooling said AC conductors.

15. The apparatus of claim 8 wherein said conductive shield means is positioned between said first upper AC conductor and the molten metal sheet and wherein magnetic field intensity on an upper surface of the molten metal sheet is determined by the spacing between said conductive shield means and the molten metal sheet.

16. The apparatus of claim 15 wherein said conductive shield means is electrically coupled to a solidified portion of the metal sheet and to molten metal within said vessel means to provide a closed loop for eddy currents.

17. The apparatus of claim 16 further including conductive roller means for electrically coupling said conductive shield means to the solidified portion of the metal sheet.

18. The apparatus of claim 16 further including conductive brush means for electrically coupling said conductive shield means to the solidified portion of the metal sheet.

19. The apparatus of claim 16 further including conductor means positioned within and extending out of said vessel means for electrically coupling said conductive shield means and molten metal in said vessel means.

20. The apparatus of claim 1 further comprising leader plate means coupled to the aperture in said vessel means and in contact with molten metal therein for establishing initial electromagnetic conditions within said electromagnetic conducting means prior to discharge of the molten metal sheet from said vessel means.

21. The apparatus of claim 20 wherein said leader plate means possesses electromagnetic characteristics susbtantially indentical to those of said molten metal sheet.

22. The apparatus of claim 1 further comprising gas source means for directing a coolant gas or mist on the molten metal sheet for effecting the solidification thereof.

23. The apparatus of claim 22 further comprising a liquid coolant source for directing a liquid coolant upon the thus solidified metal sheet.

24. The apparatus of claim 1 further comprising solenoid magnet means disposed around said molten metal sheet aligned along the direction of displacement of the molten metal sheet for providing vertical displacement damping and positioning stability for the molten metal sheet.

25. The apparatus of claim 1 wherein said electromagnetic conducting means includes first and second vertically spaced AC conductors positioned beneath the molten metal sheet and a generally U-shaped ferromagnetic yoke positioned beneath and laterally with respect to the molten metal sheet.

26. The apparatus of claim 25 wherein said ferromagnetic yoke includes first and second generally vertically oriented poles and a lower horizontal cross member coupling said first and second poles, wherein said horizontal cross member is positioned between said first and second conductors.

27. The apparatus of claim 26 wherein said first and second conductors are each in the form of a respective single racetrack shaped conductor.

28. The apparatus of claim 25 wherein said conductive shield means is positioned above the molten metal sheet.

29. The apparatus of claim 25 wherein said conductive shield means is positioned below the molten metal sheet.

30. The apparatus of claim 25 wherein said conductive shield means is positioned around said electromagnetic conducting means and the molten metal sheet.

31. The apparatus of claim 1 further comprising a source of gas under pressure for providing support for the molten metal sheet, wherein said magnetic field provides positioning stability for the molten metal sheet.

32. The apparatus of claim 1 further comprising a rotating drum upon which the molten metal sheet is deposited and from which the molten metal sheet is removed for cooling and solidification, wherein the levitational force exerts pressure to counteract a centrifugal force of rotation and maintain the molten metal sheet in contact with said drum.

33. The apparatus of claim 1 wherein said electromagnetic conducting means includes first and second vertically spaced AC conductors respectively positioned above and below the molten metal sheet and respectively coupled to first and second AC power supplies, wherein said second AC conductor generates a first magnetic field for exerting a constant, uniform levitation force on the molten metal sheet and said first AC conductor generates a second magnetic field for controlling the characteristics of an upper surface of the molten metal sheet.

* * * * *